US006668737B1

(12) United States Patent
Obst et al.

(10) Patent No.: US 6,668,737 B1
(45) Date of Patent: Dec. 30, 2003

(54) TRANSPORT SYSTEM COMPRISING A VEHICLE WITH GOOD CORNERING PERFORMANCE WHICH CAN BE MOVED ON RAILS

(75) Inventors: Jürgen Obst, Obertshausen (DE); Oliver Remsberger, Schliengen (DE)

(73) Assignee: Siemens Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/031,271

(22) PCT Filed: Apr. 18, 2000

(86) PCT No.: PCT/DE00/01245

§ 371 (c)(1),
(2), (4) Date: Apr. 19, 2002

(87) PCT Pub. No.: WO00/64722

PCT Pub. Date: Nov. 2, 2000

(30) Foreign Application Priority Data

Apr. 27, 1999 (DE) ..... 199 20 026

(51) Int. Cl.[7] ..... B61C 9/00
(52) U.S. Cl. ..... 109/106; 104/166
(58) Field of Search ..... 104/166, 172.1, 104/172.2, 172.3, 172.4, 2, 7.2; 105/106; 198/339.1, 341.02, 341.08; 280/33.998

(56) References Cited

U.S. PATENT DOCUMENTS 3,356,040 A * 12/1967 Fonden ..... 104/166
4,359,000 A * 11/1982 Tokunaga ..... 104/166
4,583,462 A * 4/1986 Hale ..... 104/166
5,001,987 A * 3/1991 Ziegenfus et al. ..... 104/166
5,857,413 A * 1/1999 Ward ..... 104/48
6,138,575 A * 10/2000 Geng ..... 104/172.3

FOREIGN PATENT DOCUMENTS

| | | |
|---|---|---|
| DE | 32 38 402 | 4/1984 |
| DE | 195 09 727 | 8/1996 |
| DE | 39 00 616 | 7/2001 |
| GB | 755005 | 8/1956 |

OTHER PUBLICATIONS

Copy of International Search Report for PCT/DE00//01245, which corresponds to the international phase of this application.

* cited by examiner

*Primary Examiner*—S. Joseph Morano
*Assistant Examiner*—Lars A. Olson
(74) *Attorney, Agent, or Firm*—Van Dyke, Gardner, Linn & Burkhart, LLP

(57) ABSTRACT

The invention relates to a transport system comprising rails arranged next to each other and a vehicle which is characterized by good cornering performance, can be moved on said rails and has running gears which can be pivoted about vertical axes and are mounted on a frame. Seen in the longitudinal direction of travel, the running gears on one vehicle side are mounted on the frame such that they can be moved in relation to the running gears of the opposite vehicle side. In particular, the running gears (8) of one side of the vehicle (1) are mounted on the frame (10) such that they can be linearly displaced at right angles to the longitudinal direction of travel (Q) of the vehicle (1).

20 Claims, 6 Drawing Sheets

TRANSPORT SYSTEM COMPRISING A VEHICLE WITH GOOD CORNERING PERFORMANCE WHICH CAN BE MOVED ON RAILS

BACKGROUND OF THE INVENTION

The invention relates to a transport system with a vehicle, which can be moved on rails arranged next to each other.

A supportive running gear for a trolley conveyor to allow travel on a support utility for below-ground drifting is known from German patent DE 32 38 402. The trolley conveyor exhibits two parallel rails at a certain distance from each other, on which a vehicle for the support utility can be moved. The vehicle essentially consists of two crabs which are arranged behind each other when seen in the direction of travel, and are connected with each other by means of a steering rod. A cantilever, which can be pivoted about a horizontal axis, is latched onto the first crab. A pulling device, connected to lifting gear secured to the second crab, grips the cantilever's empty end. Each of the two crabs exhibits four running gears, each of which is mounted about horizontal axes at the ends of one of the crab's cross members and can be pivoted in the direction of travel. The cross member on the other hand is connected with that part of the crab on which the arm is mounted, about a horizontal axis in the direction of travel.

Furthermore, each running gear is connected with the cross member around a vertical axis and can be rotated. In addition, as it pertains to the running gears on one vehicle side, another essentially horizontal axis transverse in direction of travel, located between the running gear and the cross member, provides for the crabs' linear displacement at right angles to the direction of travel. Due to the multitude of pivoting possibilities provided for each crab and each running gear, the vehicle at hand may also be guided on rails run irregularly. Due to the possibility of displacing the crabs' running gears transversely, even larger modifications in the rails' tracks can be offset.

Further, German patent document DE 195 09 727 C1 describes a transport system with a vehicle able to travel on rails and with good cornering performance. This transport system is not designed as a trolley conveyor, rather the vehicle travels on rails mounted on the ground and exhibits four running gears at its corner points, which are mounted around vertical axes and able to pivot. The running gears on one vehicle side are not arranged directly on the frame but via bearing shanks, whose ends are turned away from the running gears, mounted on the frame around a vertical pivot axis and are able to pivot. Due to this guiding arrangement, it is possible that, on one hand, tolerances of the rails running parallel and next to each other can be offset by the vehicle and, on the other hand, it is also possible to travel around narrow 90° curves. When seen in the direction of travel, the pivot axes of the bearing shanks are therefore arranged in the area of half the vehicle's length as well as behind each other, when seen in the direction of travel.

In order to enable travel around narrow 90° curves, the rails are specially designed for the curve area. Starting with rails running as parallel as possible, the inner rail is retracted in the direction of the outer rail in such a manner that the inner, rear running gear maintains its direction of travel while traveling through the curve area. This is done to cause the speed of the inner rear running gear to approach zero while traveling through the curve area, however not reversing its direction of travel. Therefore even narrow curve radii can be traveled smoothly as well as without bumps.

Furthermore, DE 39 00 516 A1 describes a transport system with a vehicle guided by rails and a turnout. The vehicle essentially consists of a right-angle frame, whose corner areas have running gears, which can be pivoted about vertical axes. The running gears can be moved on rails located next to and at a distance from each other. The rails of different rail paths cross each other, preferably at a right angle. The crossing areas are provided with turnouts, in order to enable the vehicles to change rail paths. The turnouts essentially consist of rail sections arranged in the rails' crossing points and can be pivoted about a vertical axis. Transferring a vehicle from the first to the second rail path takes place after the vehicle enters the turnout by moving the rail sections, which can be pivoted. Therefore the vehicle's running gears are also pivoted by 90°, and subsequently the vehicle can move in the direction of the second rail thread.

SUMMARY OF THE INVENTION

According to one aspect of the invention, a transport system is provided that includes a plurality of rails and a vehicle that travels on the rails. The vehicle includes a frame with a plurality of cross members and guide members. The frame further includes a plurality of running gears mounted thereon which are pivotable about a vertical axis. A pair of stop elements are included that can be pivoted approximately 90° about a vertical pivot axis between a cross position and a longitudinal position. At least one slide element is also mounted on the cross members that guides the running gears on the guide members in a linearly-movable manner at right angles to the longitudinal direction of travel of the vehicle.

DETAILED DESCRIPTION OF THE INVENTION

Figure 1:
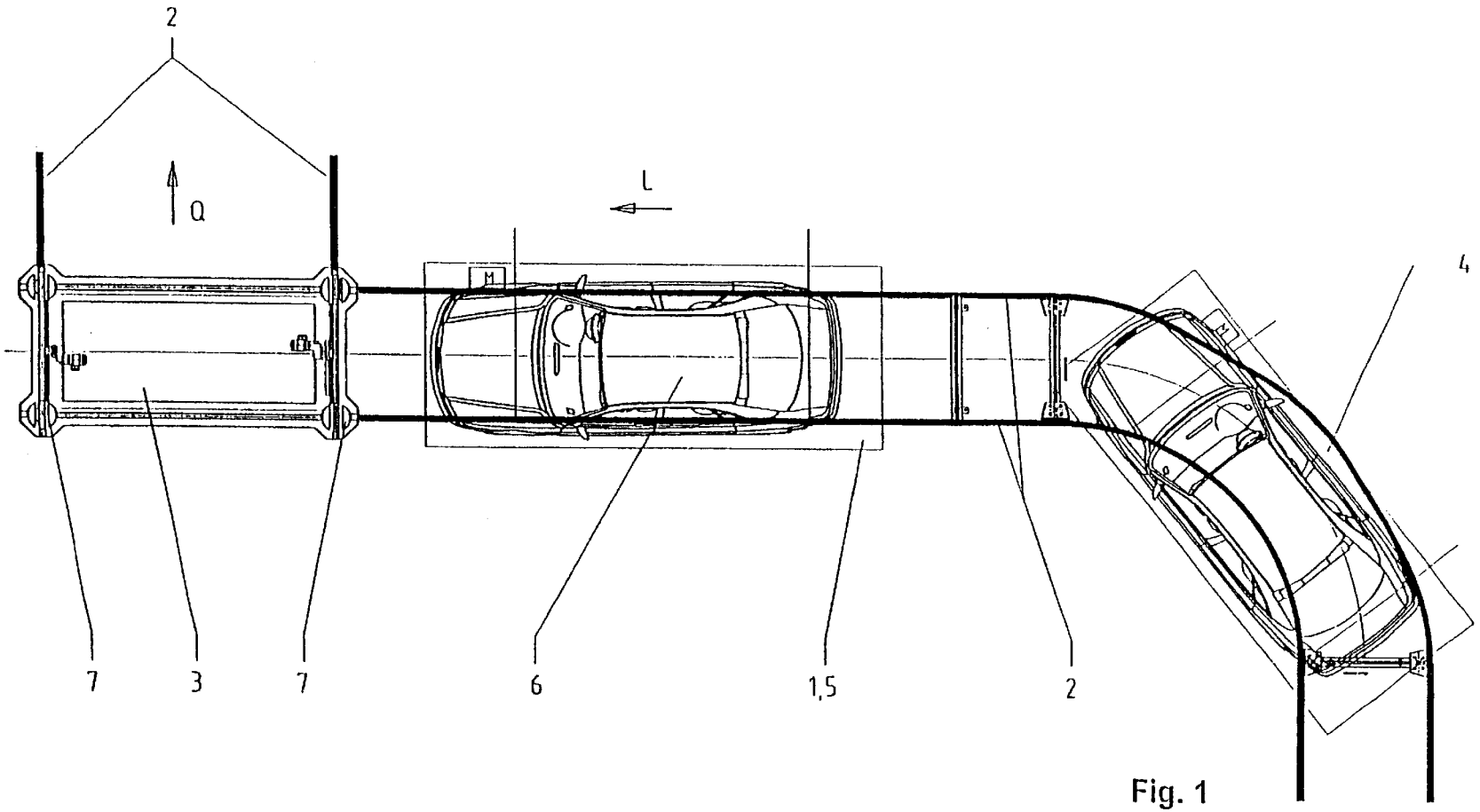
FIG. 1 is a plan view of a transport system with a vehicle according to one aspect of the invention.

The invention is based on the task of creating a transport system of the type described in the Background section, which exhibits optimized applications possibilities.

In accordance with the invention, the possibility of the running gears' linear displacement on one side of the transport system's vehicle in a transverse direction to the vehicle's longitudinal direction of travel provides that, on one hand, curves running in the vehicle's longitudinal direction of travel can be traveled and, on the other hand, turnouts known from the current state of technology and arranged in corner/cross areas can also be traveled by means of turnout rail sections, which can be pivoted about a vertical direction. Therefore the vehicles' applications have been expanded.

Advantageous design development is achieved by locking the running gears as the vehicles travel in a transverse direction, so that the movable running gears cannot move at all during transverse travel, and therefore their track is maintained in order to enable further pivoting of the running gears by 90°, when arriving at the next turnout in a corner/crossing area.

An especially simple advantageous design development of the running gears' retention exists with protrusions protruding to the outside from the running gears' outer circumference. These protrusions abut to adjustable stop elements with the running gears pivoted in the transverse direction of travel. These stop elements are mounted on the vehicle's cross members. Due to the linear guidance of the running gears to allow their transverse displacement, a more direct introduction of forces into the vehicle's frame is possible, compared with the use of guide bars. Quiet travel without bumps is ensured, as forces are introduced into the vehicle's frame at the vehicle's corner points.

Construction space as well as construction height are conserved. Furthermore, as the possibility for linear displacement already disallows displacing the running gear in the longitudinal direction of travel, power locking can be dispensed with when locking for transverse travel. In especially simple cases, only the previously described protrusions and stops are required. The running gears may also be completely and easily dismounted from the transversely running guide elements as well as remounted for maintenance work. Further, the use of guide rails and slide elements for the running gears' transverse movement is especially advantageous in that a low push resistance also results in low steering forces.

This vehicle is especially suitable for use on rails whose cross sections are designed in I-shape and braced with ground supports. This transportation system is therefore suitable for traveling around stock areas, whose outline is designed mostly at a right angle, in order to pick up or drop off piece goods from individual stock areas. The invention is also suitable for vehicles and rails in the trolley conveyor area.

Illustration 1 depicts a top view onto a transport system with vehicle 1 with good cornering performance on a section with two parallel rails 4, which are at a distance from each other and aligned largely parallel to each other at least on their straight paths. The run of rails 2 indicates that, on one hand, corner/crossing areas 3 and, on the other hand, curve areas 4 can be traveled by vehicles 1. The actual vehicle 1 is not obvious in illustration 1, as skid 5 lies on each vehicle. Skid 5 transports vehicle 6. Vehicles 1 are able to change from longitudinal direction of travel L into transverse direction of travel Q in corner/crossing area 3. Therefore two short turnout rail pieces 7 are provided in the rails' crossing points directed in longitudinal direction of travel L as well as transverse direction of travel Q. Turnout rail pieces 7 can pivot about a vertical axis by at least 90° from the longitudinal direction of travel L to the transverse direction of travel Q as well as vice versa, as required. These turnout rail pieces may be designed according to those disclosed in DE 39 00 615 A1 referenced herein in the Background section, and incorporated herein by reference at the beginning. The pivoting of turnout rail pieces 7 occurs immediately after vehicle 1 with running gears 8 (see FIG. 2) which may also pivot about vertical axes 9, comes to a halt on turnout rail pieces 7 and as soon as axes 9 of running gears 8 as well as the pivot axes of turnout rail pieces 7, align with each other. It is therefore possible that vehicle 1 arriving in longitudinal direction of travel L may leave corner/crossing area 3 in the transverse direction of travel Q by means of jointly pivoting the turnout rail pieces 7 and the running gears 8 by 90° each.

Figure 2:
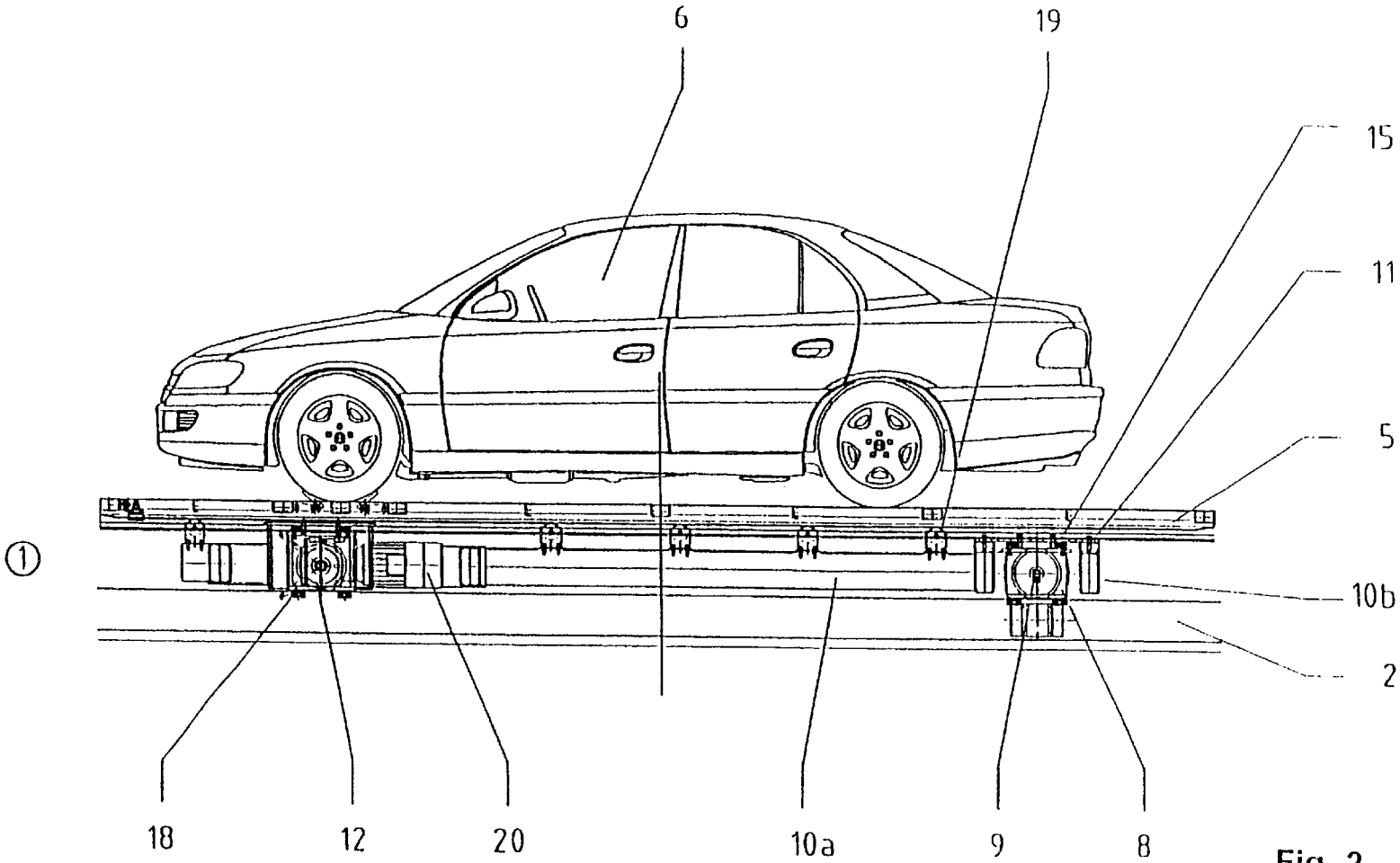
FIG. 2 is a side view of one of the vehicles of FIG. 1.
Figure 3:
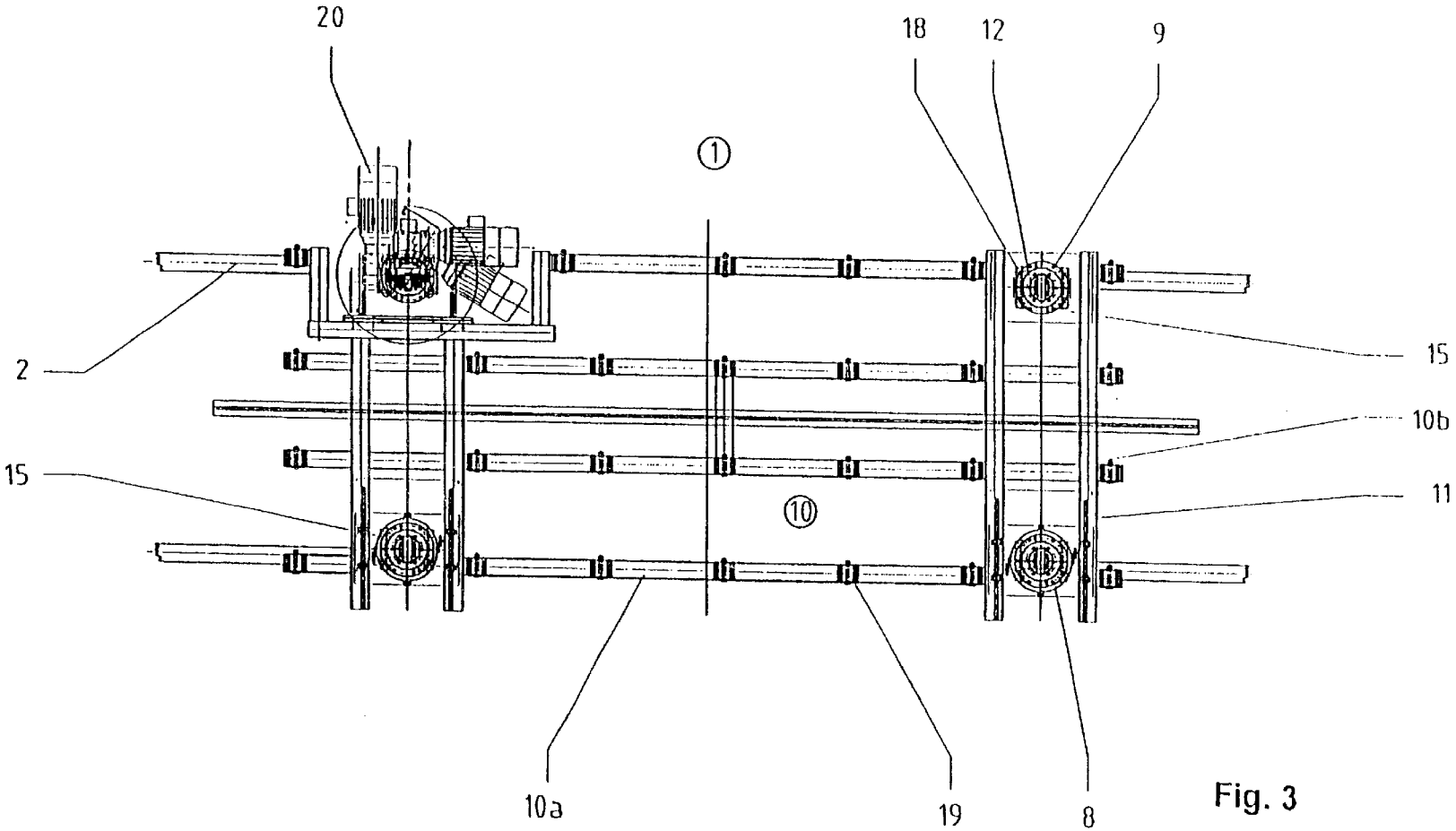
FIG. 3 is plan view of the vehicle of FIG. 2.
Figure 6:
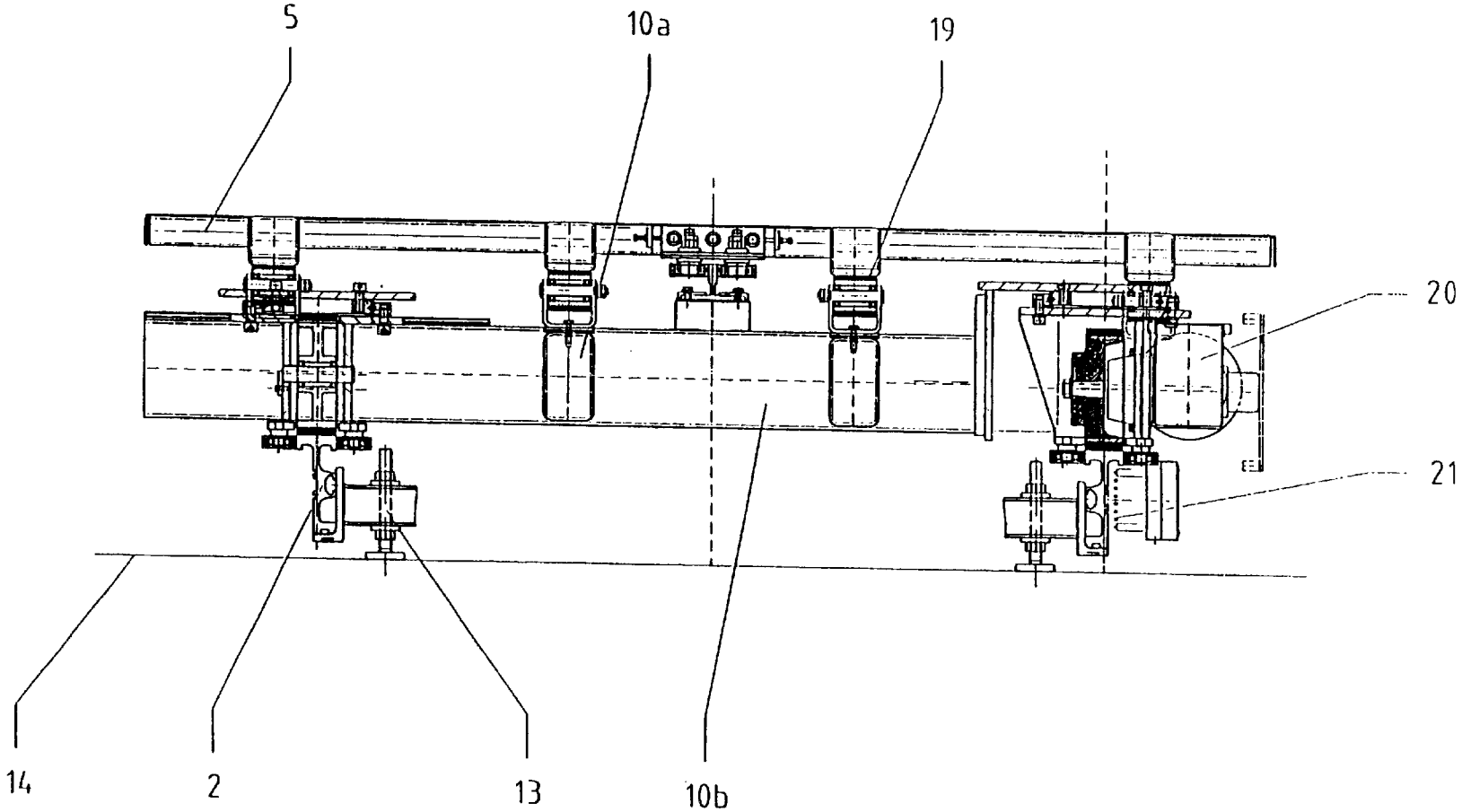
FIG. 6 is a front view of the vehicle of FIG. 2.

FIG. 2 depicts a side view of vehicle 1 on a straight section of rail 2. FIGS. 3 and 6 show a top and front view of FIG. 2, respectively. FIGS. 2, 3 and 6 describe the design of vehicle 1 in more detail. FIG. 3 shows that the vehicle features rectangular frame 10 with four parallel side members 10*a* running at a distance as well as in a longitudinal direction of travel L. Seen in the longitudinal direction of travel L, side member 10*a*'s front and rear ends are connected with each other via two cross members 10 each. Only the two inner side members 10*a* run the entire length of vehicle 1.

The two outer side members 10*a* are broken through in the area between cross members 10*b*, which are arranged at a distance from each other. It is apparent that the acquired construction space is used to store running gears 8, which are arranged in the corner points of frame 10. Running gears 8 essentially consist of one wheel or castor 12 (see FIG. 4), which runs on the surface of rail 2. Rail 2 is therefore supported via support 13 on the ground 14 in a factory, plant, or other type of facility. Each castor 12 is mounted about vertical axis 9 and pivots. FIG. 2 shows that the bearing of the running gears is done via connection plate 15, which is arranged on cross members 10*b*.

FIG. 3 further shows that running gears 8 of vehicle 1's left side, when seen in the longitudinal direction of travel L, are additionally mounted transversely to the longitudinal direction of travel L and can be displaced. It is therefore also possible to move vehicle 1 through curves wherein the axial distance of running gears 8 facing each other may change in the curves, depending on the design of the run of rails 2. In order to allow the left running gears 8's linear possibility of transverse displacement, connection plate 5 is mounted on the top sides of cross members 10*b* via guide elements 11. Guide elements 11 permit displacement of running gears 8 only in a direction transverse to the longitudinal direction of travel L.

FIGS. 2, 3, and 6 furthermore show that bearing rollers 19 are provided on cross members 10*a*. Skid 5 with motor vehicle 6 sits on these bearing rollers. Skid 5 is therefore kept on bearing rollers 19, and hence on vehicle 1, via locking, which is not depicted. The illustrations also show that the running gear is powered by drive motor 20, which is flanged to running gear 8. In this context, FIG. 6 shows that conductor lines 21 run along the I-shaped rails. Drive motor 20 is provided with power via these conductor lines.

Figure 4:
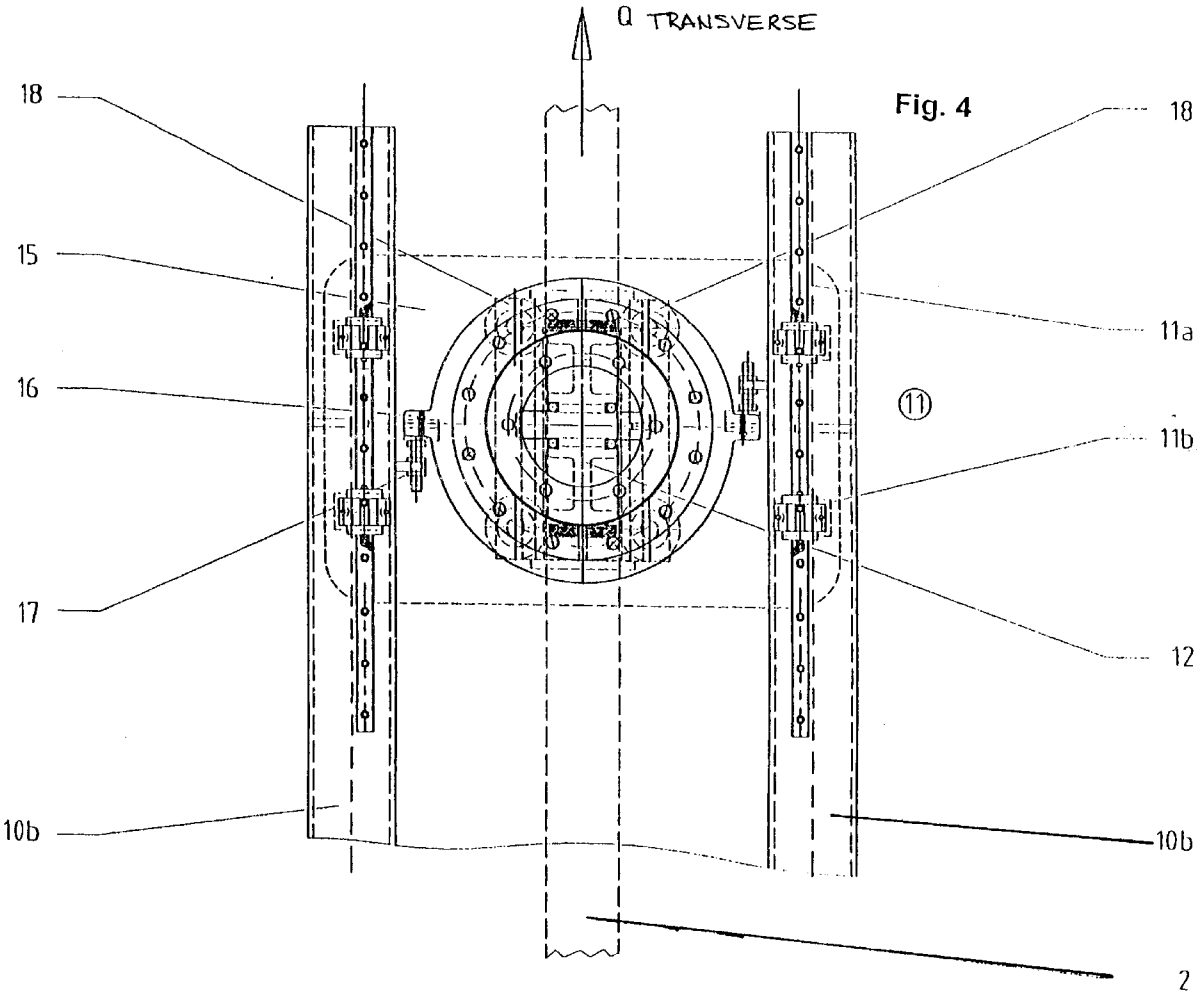
FIG. 4 is an enlarged section of the running gear area during the vehicle's transverse travel.
Figure 5:
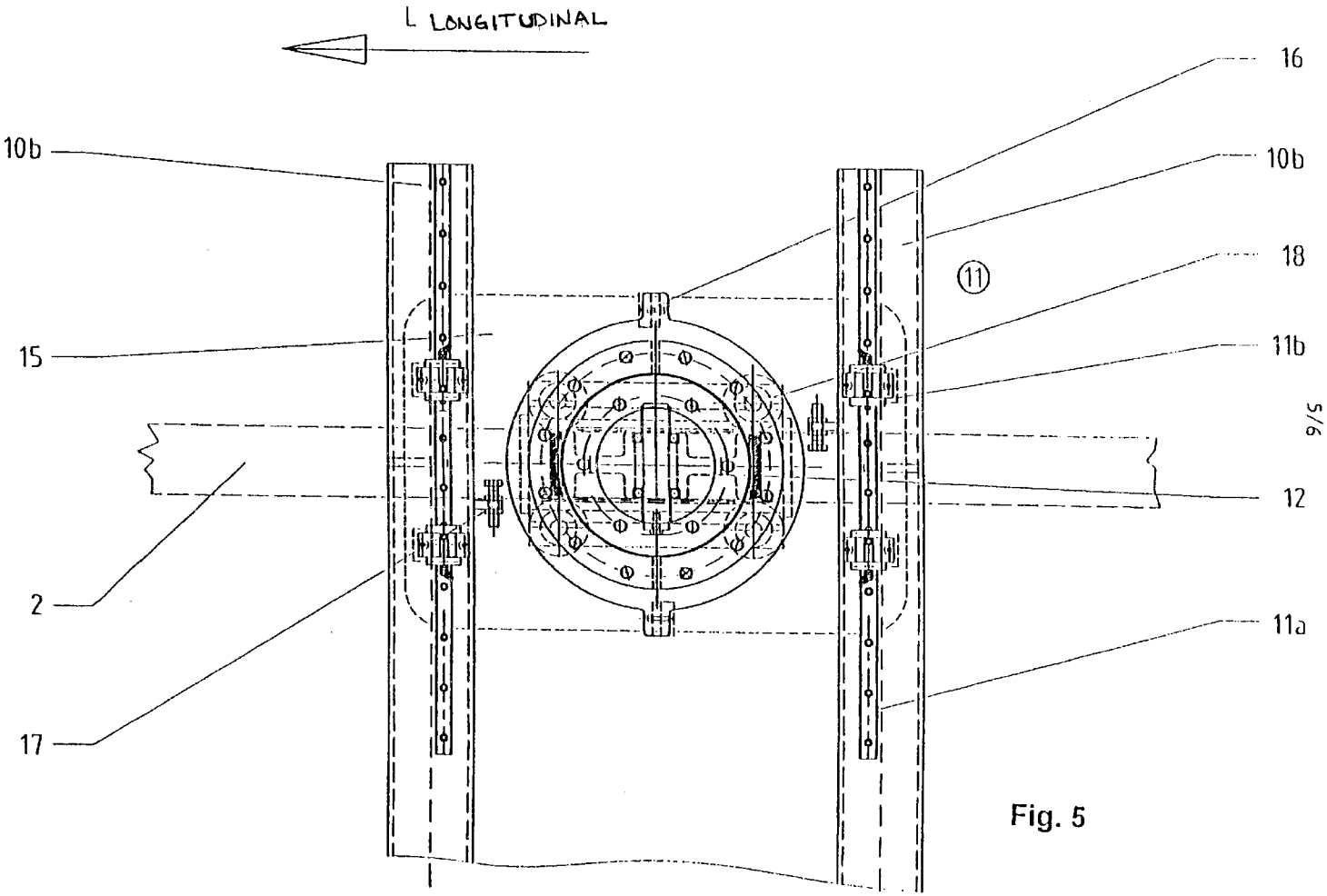
FIG. 5 is an enlarged section of the running gear area during the vehicle's longitudinal travel.

FIGS. 4 and 5 each further show an enlarged section of a running gear area from FIG. 3, when vehicle 1 is traveling in a transverse and longitudinal direction, respectively. FIGS. 4 and 5 also depict the detailed construction of guide element 110.

Guide element 11 essentially consists of guide rail 11*a*, which is screwed onto the top side of cross member 10*b*, as well as slide elements 11*b*, which embrace the guide rail, and can be displaced alongside of it. They are connected with connection plate 15 on the side opposite guide rail 11*a*.

FIG. 5 further shows that stops or protrusions 16 are provided alongside running gear 8. These protrusions protrude from running gear 8's circumferential outline. Stops 16 have no function during vehicle 1's longitudinal direction of travel and are therefore in an idle position. FIG. 4, on the contrary, shows protrusions 16's position when in operation. FIG. 4 depicts running gear 8 during vehicle 1's transverse direction of travel. Therefore, running gear 8 is pivoted by 90° about its axis 9, and protrusions 16 abut against adjustable stop elements 17, which are connected with cross members 10*b*. This warrants that the possibility of transverse displacement of the running gears 8 on the left side of vehicle 1, which is desired for vehicle 1's travel in the longitudinal direction of travel L, is canceled during transverse travel. With this arrangement working together with running gear 8, which is traveling on rail 2 and is additionally guided along the outer sides of rail 2 by guide rollers 18, which are mounted on the running gear about vertical axes and can be pivoted, running gear 8 is maintained in a defined position even when traveling in the transverse direction Q. This is necessary, as the wheel tracks of wheels 12 may not change during entry into a subsequent corner/crossing area with turnout rail pieces 7, which can pivot.

Symbol reference list

1 Vehicle
2 Rail
3 Corner/crossing area
4 Curve area
5 Skid
6 Motor vehicle
7 Turnable turnout rails
8 Running gears
9 Axes
10 Frame
10*a* Side member
10*b* Cross member
11 Guide element
11*a* Guide rail
11 11*b* Slide element
12 Wheel
13 Support
14 Ground
15 Connection plate
16 Protrusion
17 Stop element
18 Guide rollers
19 Bearing rollers
20 Drive motor
21 Conductor lines
L Longitudinal direction of travel
Q Transverse direction of travel Transport system with a vehicle, which can be moved on rails and exhibits good cornering performance characteristics Description The invention relates to a transport system with a vehicle, which can be moved on rails arranged next to each other and has good cornering performance according to the generic term in claim 1.

A supportive running gear for a trolley conveyor to allow travel on a support utility for below-ground drifting is known from German patent DE 32 38 402. The trolley conveyor exhibits two parallel rails at a certain distance from each other, on which a vehicle for the support utility can be moved. The vehicle essentially consists of two crabs which are arranged behind each other when seen in the direction of travel, and are connected with each other by means of a steering rod. A cantilever, which can be pivoted about a horizontal axis, is latched onto the first crab. A pulling device, connected to lifting gear secured to the second crab, grips the cantilever's empty end. Each of the two crabs exhibits four running gears, each of which is mounted about horizontal axes at the ends of one of the crab's cross members and can be pivoted in the direction of travel. The cross member on the other hand is connected with that part of the crab on which the arm is mounted, about a horizontal axis in direction of travel.

Furthermore, each running gear is connected with the cross member around a vertical axis and can be rotated. In addition, as it pertains to the running gears on one vehicle side, another essentially horizontal axis transverse in direction of travel, located between the running gear and the cross member, provides for the crabs' linear displacement at right angles to the direction of travel. Due to the multitude of pivoting possibilities provided for each crab, respectively each running gear, the vehicle at hand may also be guided on rails run irregularly. Due to the possibility of displacing the crabs' running gears transversely, even larger modifications in the rails' tracks can be offset.

Further, German patent document DE 195 09 727 C1 describes a transport system with a vehicle able to travel on rails and with good cornering performance. This transport system is not designed as a trolley conveyor, rather the vehicle travels on rails mounted on the ground and exhibits four running gears at its corner points, which are mounted around vertical axes and able to pivot. The running gears on one vehicle side are not arranged directly on the frame but via bearing shanks, whose ends are turned away from the running gears, mounted on the frame around a vertical pivot axis and are able to pivot. Due to this guiding arrangement, it is possible that, on one hand, tolerances of the rails running parallel and next to each other can be offset by the vehicle and, on the other hand, it is also possible to travel around narrow 90° curves. When seen in the direction of travel, the pivot axes of the bearing shanks are therefore arranged in the area of half the vehicle's length as well as behind each other, when seen in the direction of travel.

In order to enable travel around narrow 90° curves, the rails are specially designed for the curve area. Starting with rails running as parallel as possible, the inner rail is retracted in the direction of the outer rail in such a manner that the inner, rear running gear maintains its direction of travel while traveling through the curve area. This is done to cause the speed of the inner rear running gear to approach zero while traveling through the curve area, however not reversing its direction of travel. Therefore even narrow curve radii can be traveled smoothly as well as without bumps.

Furthermore, DE 39 00 516 A1 describes a transport system with a vehicle guided by rails and a turnout. The vehicle essentially consists of a right-angle frame, whose corner areas have running gears, which can be pivoted about vertical axes. The running gears can be moved on rails located next to and at a distance from each other. The rails of different rail paths cross each other, preferably at a right angle. The crossing areas are provided with turnouts, in order to enable the vehicles to change rail paths. The turnouts essentially consist of rail sections arranged in the rails' crossing points and can be pivoted about a vertical axis.

Transferring a vehicle from the first to the second rail path takes place after the vehicle enters the turnout by moving the rail sections, which can be pivoted. Therefore the vehicle's running gears are also pivoted by 90°, and subsequently the vehicle can move in the direction of the second rail thread.

The invention is based on the task of creating a transport system of the aforementioned type, which exhibits optimized applications possibilities.

This task of developing a transport system is accomplished with the characteristics listed in claim 1. Advantageous design developments of the invention are noted in sub-claims 2 to 7.

In accordance with the invention, the possibility of the running gears' linear displacement on one side of the transport system's vehicle in transverse direction to the vehicle's longitudinal direction of travel provides that, on one hand, curves running in the vehicle's longitudinal direction of travel can be traveled and, on the other hand, turnouts known from the current state of technology and arranged in corner/cross areas can also be traveled by means of turnout rail sections, which can be pivoted about a vertical direction. Therefore the vehicles' applications have been expanded.

Advantageous design development is achieved by locking the running gears as the vehicles travel in a transverse direction, so that the movable running gears cannot move at all during transverse travel, and therefore their track is maintained in order to enable further pivoting of the running gears by 90°, when arriving at the next turnout in a corner/crossing area.

An especially simple advantageous design development of the running gears' retention exists with protrusions protruding to the outside from the running gears' outer circumference. These protrusions abut to adjustable stop elements with the running gears pivoted in the transverse direction of travel. These stop elements are mounted on the vehicle's cross members. Due to the linear guidance of the running gears to allow their transverse displacement, a more direct introduction of forces into the vehicle's frame is possible, compared with the use of guide bars. Quiet travel without bumps is ensured, as forces are introduced into the vehicle's frame at the vehicle's corner points.

Construction space as well as construction height are conserved. Furthermore, as the possibility for linear displacement already disallows displacing the running gear in the longitudinal direction of travel, power locking can be dispensed with when locking for transverse travel. In especially simple cases, only the previously described protrusions and stops are required. The running gears may also be completely and easily dismounted from the transversely running guide elements as well as remounted for maintenance work.

Further, the use of guide rails and slide elements for the running gears' transverse movement is especially advantageous in that a low push resistance also results in low steering forces.

This vehicle is especially suitable for use on rails whose cross sections are designed in I-shape and braced with ground supports. This transportation system is therefore suitable for traveling around stock areas, whose outline is designed mostly at a right angle, in order to pick up or drop off piece goods from individual stock areas. The invention is also suitable for vehicles and rails in the trolley conveyor area.

The following drawing describes a design development example of the invention in more detail. Shown are:

- Illustration 1 top view of a transport system with a vehicle with good cornering performance on a rail section,
- Illustration 2 side view of a vehicle with good cornering performance,
- Illustration 3 top view of illustration 2,
- Illustration 4 front view of illustration 2,
- Illustration 5 enlarged section of the running gear area during the vehicle's longitudinal travel from illustration 3, and
- Illustration 6 enlarged section of the running gear area during the vehicle's transverse travel from illustration 3.

Illustration 1 depicts a top view onto a transport system with vehicle 1 with good cornering performance on a section with two parallel rails 4, which are at a distance from each other and aligned largely parallel to each other at least on their straight paths. The run of rails 2 indicates that, on one hand, corner/crossing areas 3 and, on the other hand, curve areas 4 can be traveled by vehicles 1. The actual vehicle 1 is not obvious in illustration 1, as skid 5 lies on each vehicle. Skid 5 transports vehicle 6. Vehicles 1 are able to change from longitudinal direction of travel L into transverse direction of travel Q in corner/crossing area 3. Therefore two short turnout rail pieces 7 are provided in the rails' crossing points directed in longitudinal direction of travel L as well as transverse direction of travel Q. Turnout rail pieces 7 can pivot about a vertical axis and essentially by 90° from longitudinal direction of travel L into transverse direction of travel Q as well as vice versa, as required. These turnout rail pieces may be designed according DE 39 00 615 A1 referenced at the beginning. The pivoting of turnout rail pieces 7 occurs immediately after vehicle 1 with running gears 8 (see illustration 2) which may also pivot about vertical axes 9, comes to a halt on turnout rail pieces 7 as soon as axes 9 of running gears 8 as well as the pivot axes of turnout rail pieces 7 align with each other. It is therefore possible that vehicle 1 arriving in longitudinal direction of travel L may leave corner/crossing area 3 in the transverse direction of travel Q by means of jointly pivoting turnout rail pieces 7 and running gears 8 by 90° each.

Illustration 2 depicts a side view of vehicle 1 on a straight section of rail 2. Illustrations 3 and 4 each show a top, respectively front view of illustration 2. Illustrations 2 to 4 subsequently describe the design development of vehicle 1 in more detail. Illustration 3 shows that the vehicle features rectangular frame 10 with four parallel side members 10*a* running at a distance as well as in longitudinal direction of travel L. Seen in longitudinal direction of travel L, side member 10*a*'s front and rear ends are connected with each other via two cross members 10 each. Only the two inner side members 10*a* run the entire length of vehicle 1.

The two outer side members 10*a* are broken through in the area between cross members 10*b*, which are arranged at a distance from each other. It is apparent that the acquired construction space is used to store running gears 11, which are arranged in the corner points of frame 10. Running gears 11 essentially consist of one wheel 12 (see illustration 4), which runs on the surface of rail 2. Rail 2 is therefore supported via support 13 on ground 14 in a factory hall. Each castor 12 is mounted about vertical axis 9 and pivots. Illustration 2 shows that the bearing of the running gears is done via connection plate 15, which is arranged on cross members 10*b*.

FIG. 3 further shows that running gears 8 of vehicle 1's left side, when seen in longitudinal direction of travel L, are additionally mounted transversely to the longitudinal direction of travel L and can be displaced. It is therefore also possible to travel through curves with vehicle 1, whereby the axis distance of running gears 8 facing each other may change in curves, depending on the design of the run of rails 2. In order to allow the left running gears 8's linear possibility of transverse displacement, connection plate 5 is mounted on the top sides of cross members 10*b* via guide elements 11. Guide elements 11 permit only one displacement of running gears 8 transverse to longitudinal direction of travel L and not in longitudinal direction of travel L.

FIGS. 2, 3, and 6 furthermore show that bearing rollers 19 are provided on cross members 10*a*. Skid 5 with motor vehicle 6 sits on these bearing rollers. Skid 5 is therefore kept on bearing rollers 19, and hence on vehicle 1, via locking, which is not depicted. The illustrations also show that the running gear is powered by drive motor 20, which is flanged to running gear 8. In this context, illustration 4 shows that conductor lines 21 run along the I-shaped rails. Drive motor 20 is provided with power via these conductor lines.

Illustrations 5 and 6 each further show an enlarged section of a running gear area from illustration 3, when vehicle 1 is traveling in longitudinal direction, respectively in transverse direction. Illustrations 5 and 6 depict the detailed construction of guide element 11.

Guide element 11 essentially consists of guide rail 11*a*, which is screwed onto the top side of cross member 10*b*, as well as slide elements 11*b*, which embrace the guide rail, and can be displaced alongside of it. They are connected with connection plate 15 on the side opposite guide rail 11*a*.

Illustration 5 further shows that protrusions 16 are provided alongside running gear 8. These protrusions protrude from running gear 8's circumferential outline. Stops 16 have no function during vehicle 1's longitudinal direction of travel and are therefore in an idle position. Illustration 6 on the contrary shows protrusions 16's position when in operation. Illustration 6 depicts running gear 8 during vehicle 1's transverse direction of travel. Therefore, running gear 8 is pivoted by 90° about its axis 9, and protrusions 16 abut to adjustable stop elements 17, which are connected with cross members 10*b*. This warrants that the possibility of compensation, respectively, transverse displacement of the running gears 8 on the left side of vehicle 1, which is desired for vehicle 1's travel in longitudinal direction of travel L, is canceled during transverse travel. With this arrangement working together with running gear 8, which is traveling on rail 2 and is additionally guided along the outer sides of rail 2 by guide rollers 18, which are mounted on the running gear about vertical axes and can be pivoted, running gear 8 is maintained in a defined position even when traveling in transverse direction Q. This is necessary, as the wheel tracks of wheels 12 may not change during entry into a subsequent corner/crossing area with turnout rail pieces 7, which can pivot.

Symbol reference list

1 Vehicle
2 Rail
3 Corner/crossing area
4 Curve area
5 Skid
6 Motor vehicle
7 Turnable turnout rails
8 Running gears
9 Axes
10 Frame
10*a* Side member
10*b* Cross member
11 Guide element
11*a* Guide rail
11 11*b* Slide element
12 Wheel
13 Support
14 Ground
15 Connection plate
16 Protrusion
17 Stop element
18 Guide rollers
19 Bearing rollers
20 Drive motor
21 Conductor lines
L Longitudinal direction of travel
Q Transverse direction of travel

What is claimed is:

1. A transport system comprising:

a plurality of rails arranged next to each other;

a vehicle adapted to travel on said rails;

a frame having a plurality of cross members and a plurality of guide members, said frame further having a plurality of running gears mounted thereon, said running gears able to be pivoted about vertical axes whereby, when seen in a longitudinal direction of travel, said running gears on one vehicle side are mounted on the frame in such a way that they can be moved relative to the running gears of the opposite vehicle side;

a pair of stop element, said running gears able to be pivoted approximately 90 degrees between said stop elements into a cross position from a longitudinal position around a vertical pivot axis; and at least one slide element mounted on said cross members that guides said running gears on said guide members in a linearly-movable manner at right angles to the longitudinal direction of travel of said vehicle.

2. The transport system of claim 1 wherein at least one of the running gears is powered by means of an electric drive, which is supplied with power by conductor lines mounted on at least one of said rails.

3. The transport system of claim 2 wherein each running gear includes a wheel which is guided by means of guide rollers along one of said rails.

4. The transport system of claim 2 wherein cross sections of the rails are L-shaped and the rails are braced by way of ground supports, said vehicle being movable on a top portion of said rails.

5. The transport system of claim 4 further including guide rollers which can be moved along longitudinal sides of the top portion of the rails.

6. The transport system of claim 1 wherein each running gear includes a wheel which is guided by means of guide rollers along one of said rails.

7. The transport system of claim 6 wherein cross sections of the rails are L-shaped and the rails are braced by way of ground supports, said vehicle being movable on a top portion of said rails.

8. The transport system of claim 7 further including guide rollers which can be moved along longitudinal sides of the top portion of the rails.

9. The transport system of claim 1 wherein cross sections of the rails are L-shaped and the rails are braced by way of ground supports, said vehicle being movable on a top portion of said rails.

10. The transport system of claim 9 further including guide rollers which can be moved along longitudinal sides of the top portion of the rails.

11. A transport system comprising:

a plurality of rails arranged next to each other;

a vehicle adapted to travel on said rails;

a frame having a plurality of cross members and a plurality of guide members, said frame further having a plurality of running gears mounted thereon, said running gears able to be pivoted about vertical axes whereby, when seen in a longitudinal direction of travel, said running gears on one vehicle side are mounted on the frame in such a way that they can be moved relative to the running gears of the opposite vehicle side;

a pair of stop elements, said running gears able to be pivoted approximately 90 degrees between said stop elements into a cross position from a longitudinal position around a vertical pivot axis, said stop elements being mounted on the cross members of the frame in an adjustable manner and positioned to engage an outwardly protruding protrusion on said running gears; and at least one slide element mounted on said cross members that guides said running gears on said guide members in a linearly-movable manner at right angles to the longitudinal direction of travel of said vehicle.

12. The transport system of claim 11 wherein at least one of the running gears is powered by means of an electric drive, which is supplied with power by conductor lines mounted on at least one of said rails.

13. The transport system of claim 11 wherein each running gear includes a wheel which is guided by means of guide rollers along one of said rails.

14. The transport system of claim 11 wherein cross sections of the rails are L-shaped and the rails are braced by way of ground supports, said vehicle being movable on a top portion of said rails.

15. The transport system of claim 14 further including guide rollers which can be moved along longitudinal sides of the top portion of the rails.

16. A vehicle for transporting items on a plurality of rails arranged next to each other, said vehicle comprising:

frame for supporting items to be transported, said frame having first and second sides;

a first wheel mounted to said frame adjacent said first side and positioned to engage one of the rails;

a second wheel mounted to said frame adjacent said second side and positioned to engage another one of the rails, said second wheel being spaced from said first wheel by a distance; and a track attached to said frame and extending in a direction from said first side toward said second side, said track positioned adjacent said second wheel and adapted to allow said second wheel to move toward and away from said first wheel such that said distance between said first and second wheels can be changed.

17. The vehicle of claim 16 wherein said first and second wheels rotate about horizontal axles and said first and second wheels are mounted to said frame such that said horizontal axles can be pivoted about vertical axes.

18. The vehicle of claim 17 further including a plurality of stops supported on said frame, said stops adapted to limit the pivoting of said horizontal axles about said vertical axes to substantially ninety degrees.

19. The vehicle of claim 16 further including:

a third wheel mounted to said frame adjacent said first side and positioned to engage said one of the rails;

a fourth wheel mounted to said frame adjacent said second side and positioned to engage said another one of the rails, said fourth wheel being spaced from said third wheel by a second distance; and a second track attached to said frame and extending in a direction from said first side toward said second side, said second track positioned adjacent said fourth wheel and adapted to allow said fourth wheel to move toward and away from said third wheel such that said second distance between said third and fourth wheels can be changed.

20. The vehicle of claim 19 wherein at least one of said first and second wheels is powered by an electric motor.

* * * * *